US009598991B2

(12) United States Patent
Kira et al.

(10) Patent No.: US 9,598,991 B2
(45) Date of Patent: Mar. 21, 2017

(54) OIL SEPARATOR

(71) Applicants: AISIN SEIKI KABUSHIKI KAISHA, Kariya-shi (JP); TOYOTA JIDOSHA KABUSHIKI KAISHA, Toyota (JP)

(72) Inventors: Naoki Kira, Nagoya (JP); Atsushi Nishigaki, Anjo (JP); Jun Ikeda, Nagoya (JP); Shin Satsumabayashi, Toyota (JP)

(73) Assignees: AISIN SEIKI KABUSHIKI KAISHA, Kariya-Shi, Aichi (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 132 days.

(21) Appl. No.: 14/412,063

(22) PCT Filed: Jun. 28, 2013

(86) PCT No.: PCT/JP2013/067839
§ 371 (c)(1),
(2) Date: Dec. 30, 2014

(87) PCT Pub. No.: WO2014/007165
PCT Pub. Date: Jan. 9, 2014

(65) Prior Publication Data

US 2015/0337697 A1 Nov. 26, 2015

(30) Foreign Application Priority Data

Jul. 4, 2012 (JP) ..... 2012-150722

(51) Int. Cl.
*F01M 13/00* (2006.01)
*F01M 13/04* (2006.01)
*F01M 13/02* (2006.01)

(52) U.S. Cl.
CPC ..... *F01M 13/04* (2013.01); *F01M 13/00* (2013.01); *F01M 13/02* (2013.01); *F01M 13/021* (2013.01);
(Continued)

(58) Field of Classification Search
CPC ..... F01M 13/04; F01M 13/00; F01M 13/02; F01M 2013/0438; F01M 2013/0427; F01M 2013/0422
(Continued)

(56) References Cited

U.S. PATENT DOCUMENTS 6,279,556 B1 8/2001 Busen et al.
7,011,690 B2 * 3/2006 Altvater ..... F01M 13/023 55/312
(Continued)

FOREIGN PATENT DOCUMENTS

JP 62-129165 A 6/1987
JP 2002-540338 A 11/2002
(Continued)

OTHER PUBLICATIONS

U.S. Appl. No. 14/412,088, filed Dec. 30, 2014, Nishigaki et al.
(Continued)

*Primary Examiner* — Hung Q Nguyen
*Assistant Examiner* — Charles Brauch
(74) *Attorney, Agent, or Firm* — Buchanan Ingersoll & Rooney PC

(57) ABSTRACT

An oil separator is provided that efficiently recovers oil mist in blow-by gas regardless of differences in particle diameter. The oil separator includes a supply space to which blow-by gas from an internal combustion engine is supplied, and multiple cyclone-type oil separation units arranged along the gas supply direction, each having a cylindrical cylinder case part to which the blow-by gas from the supply space is
(Continued)

supplied. An inner diameter of the cylinder case part of the oil separation unit is set larger with the oil separation unit arranged more upstream in the gas supply direction.

4 Claims, 2 Drawing Sheets

(52) U.S. Cl.
CPC ... *F01M 13/022* (2013.01); *F01M 2013/0066* (2013.01); *F01M 2013/0422* (2013.01); *F01M 2013/0427* (2013.01); *F01M 2013/0438* (2013.01)

(58) Field of Classification Search
USPC ..... 123/41.86
See application file for complete search history.

(56) References Cited

U.S. PATENT DOCUMENTS

| | | | | |
|---|---|---|---|---|
| 2003/0221398 | A1* | 12/2003 | Trautmann ..... | B01D 45/12 55/346 |
| 2004/0237484 | A1 | 12/2004 | Altvater et al. | |
| 2006/0090737 | A1 | 5/2006 | Pietschner | |
| 2006/0112941 | A1 | 6/2006 | Hilpert et al. | |
| 2009/0229585 | A1 | 9/2009 | Tanaka et al. | |
| 2009/0241919 | A1 | 10/2009 | Janssen et al. | |
| 2011/0120592 | A1 | 5/2011 | Gabler et al. | |

FOREIGN PATENT DOCUMENTS

| | | | |
|---|---|---|---|
| JP | 2006-505732 | A | 2/2006 |
| JP | 2007-512943 | A | 5/2007 |
| JP | 2009-221857 | A | 10/2009 |
| JP | 2009-221858 | A | 10/2009 |
| JP | 2010-84574 | A | 4/2010 |
| JP | 2011-047306 | A | 3/2011 |
| JP | 2011-110551 | A | 6/2011 |
| JP | 2012-002139 | A | 1/2012 |
| JP | 2012-112267 | A | 6/2012 |
| KR | 10-0847861 | B1 | 7/2008 |
| WO | WO 2011/025136 | A2 | 3/2011 |

OTHER PUBLICATIONS

Notification of Transmittal of Translation of the International Preliminary Report on Patentability issued on Jan. 15, 2015, by WIPO in corresponding International Application No. PCT/JP2013/06783. (8 pages).

International Search Report (PCT/ISA/210) mailed on Aug. 6, 2013, by the Japanese Patent Office as the International Searching Authority for International Application No. PCT/JP2013/067839.

Written Opinion (PCT/ISA/237) mailed on Aug. 6, 2013, by the Japanese Patent Office as the International Searching Authority for International Application No. PCT/JP2013/067839.

Japanese Office Action issued on Sep. 4, 2014 for corresponding Japanese Application No. 2012-150722 and English language translation of relevant portion of Office Action (6 pages).

U.S. Appl. No. 14/440,446, filed May 4, 2015, Kira et al.

Chinese Official Action issued Jun. 14, 2016, by the Chinese Patent Office, in corresponding Chinese Patent Application No. 201380034468.6 with English-language translation of Chinese Official Action (13 pages).

* cited by examiner

OIL SEPARATOR

TECHNICAL FIELD

The present invention relates to an oil separator that separates oil mist from blow-by gas.

BACKGROUND ART

In an engine, when gas mixture is introduced to a combustion chamber during running, some unburned gas mixture leaks into the crankcase through the gap between the piston and the cylinder. This leaked gas is called blow-by gas, and it is prohibited by law to discharge this blow-by gas as is into the atmosphere as exhaust gas. For this reason, blow-by gas is returned to the intake port via a PCV (Positive Crankcase Ventilation) passage, reintroduced into the combustion chamber along with new gas mixture, and burned in the combustion chamber.

Blow-by gas contains lubricating oil such as engine oil in the form of an oil mist, and it is not preferable for blow-by gas containing oil mist to be returned to the intake port since oil will stick to the PCV passage and the periphery of the intake port. In view of this, an oil separator is provided inside the cylinder head cover or within the PCV passage as a means for collecting the oil mist in blow-by gas.

Patent Document 1 discloses an oil separator that employs multiple cyclones. In this oil separator, blow-by gas flowing in through a gas introducing opening is passed through a straightening chamber and introduced to multiple cyclones arranged in a line. Due to centrifugal force from the swirling flow produced inside the cyclones, the oil mist in the blow-by gas coagulates and becomes collected.

CITATION LIST

Patent Literature

Patent Document 1: JP 2009-221857A

SUMMARY OF INVENTION

Blow-by gas contains oil mist particles having various particle diameters. In the oil separator disclosed in Patent Document 1, the blow-by gas introduction opening is located in one end portion, and the distance from the gas introducing opening differs for each of the cyclones arranged in a line. Also, a large amount of oil mist particles having a large particle diameter is present in the vicinity of the gas introducing opening, and the particle diameter of the present oil mist particles decreases with increasing distance from the gas introducing opening. This is because oil mist particles with a large particle diameter have a large mass. For this reason, a large amount of oil mist particles having a large particle diameter is collected by the cyclone near the gas introducing opening, and the particle diameter of the oil mist particles collected by the cyclones decreases with increasing distance from the gas introducing opening. Since oil mist particles having different particle diameters are collected by the respective cyclones in this way, there has been a problem that differences appear in the collection efficiencies of the cyclones, and it is not possible to efficiently collect oil mist.

Also, with the oil separator disclosed in Patent Document 1, the blow-by gas discharge opening is located in the end portion on the side opposite to the gas introducing opening, and therefore imbalance arises in the discharge efficiency when blow-by gas from which oil mist has been separated is sucked out and discharged from the respective cyclones. This is because blow-by gas is discharged due to negative pressure, and the force of the discharge of blow-by gas decreases the farther the cyclone is located from the gas discharge opening. This gives rises to a problem of poor discharge efficiency for the oil separator overall.

An object of the present invention is to rationally configure an oil separator that efficiently recovers oil mist in blow-by gas regardless of differences in particle diameter.

A feature of the present invention is that a supply passage is provided to which blow-by gas from an internal combustion engine is supplied, and a plurality of cyclone-type oil separation units are arranged along a gas supply direction, each oil separation unit having a cylinder case part to which the blow-by gas is supplied, wherein compared to an inner diameter of the cylinder case part of the oil separation unit arranged upstream in the gas supply direction of the supply passage, an inner diameter of the cylinder case part of the oil separation unit arranged downstream in the gas supply direction is set smaller.

The mist particles contained in the blow-by gas that have a smaller particle diameter float in the gas more easily and move a longer distance along with the gas compared to the particles that have a larger particle diameter. In contrast, the mist particles that have a larger particle diameter cannot move as long a distance as the particles that have a smaller particle diameter. Also, in the supply passage, the flow speed of gas is higher the farther on the upstream side in the gas supply direction, and the flow speed of gas is lower the farther on the downstream side.

For such reasons, an oil separation unit with a cylinder case part having a predetermined inner diameter is arranged on the upstream side of the supply passage in the gas supply direction, and an oil separation unit with a cylinder case part having a smaller diameter than the predetermined inner diameter is arranged on the downstream side in the gas supply direction, thus making it possible for mist particles having a large particle diameter to be sucked into the upstream cylinder case part and mist particles having a small particle diameter to be sucked into the downstream cylinder case part. This makes it possible for mist particles having a large particle diameter to be separated out by the upstream oil separation unit, and mist particles having a small particle diameter to be separated out by the downstream oil separation unit.

Accordingly, an oil separator is provided that efficiently recovers oil mist in blow-by gas regardless of differences in particle diameter.

In the present invention, the supply passage may be configured by a supply space through which blow-by gas can be distributed, axes of the cylinder case parts of the oil separation units may be in a parallel orientation with respect to each other, the axes may each be set in an orientation orthogonal to the gas supply direction, and an intake opening formed in the cylinder case part of the oil separation unit arranged downstream in the gas supply direction may be arranged at a position so as to extend toward the supply space beyond an outer wall of the cylinder case part of the oil separation unit arranged upstream.

This configuration realizes oil separation in which blow-by gas flowing in the supply space is directly supplied to the intake openings of multiple oil separation units.

Also, the plurality of oil separation units are arranged so that the oil separation unit arranged more downstream in the gas supply direction protrudes more in a direction different from the gas supply direction.

According to this configuration, blow-by gas flowing in the supply space is more easily supplied to a downstream oil separation unit among the oil separation units.

DESCRIPTION OF EMBODIMENTS

An embodiment of the present invention will be described below with reference to the drawings.

Basic Configuration

Figure 1:
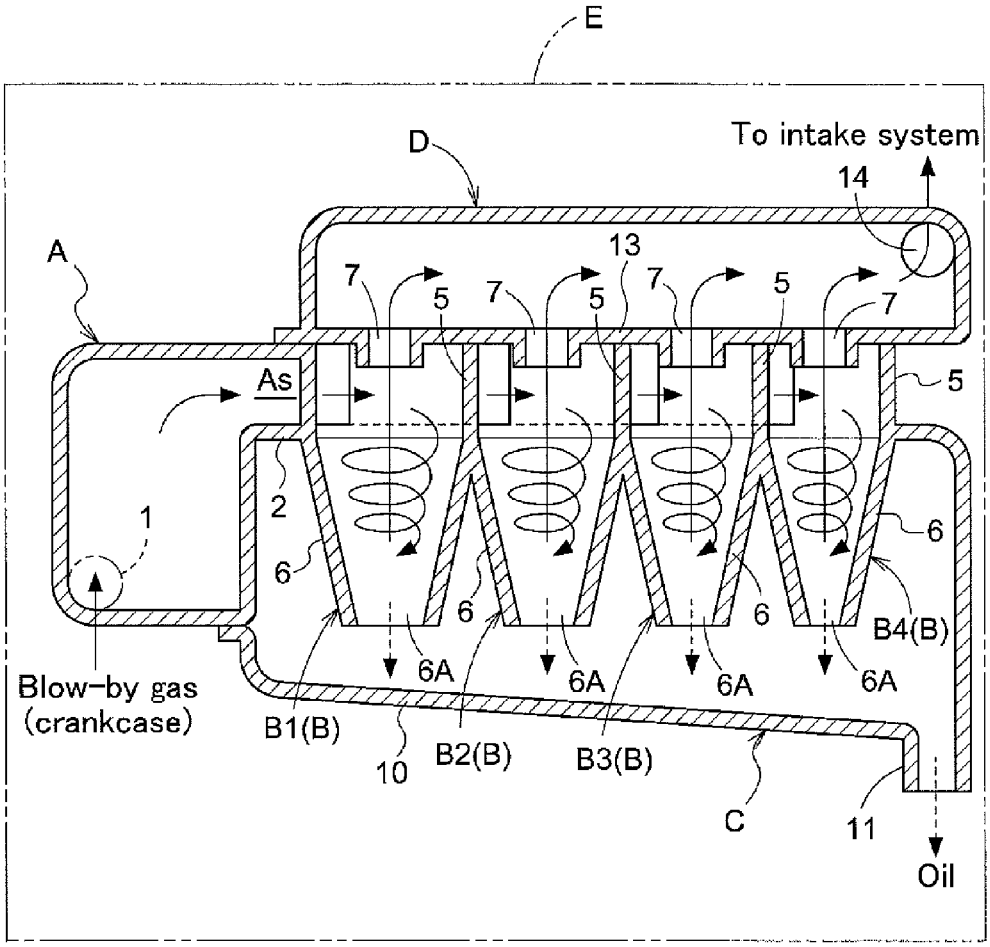
FIG. 1 is a vertical cross-sectional side view of an oil separator.
Figure 2:
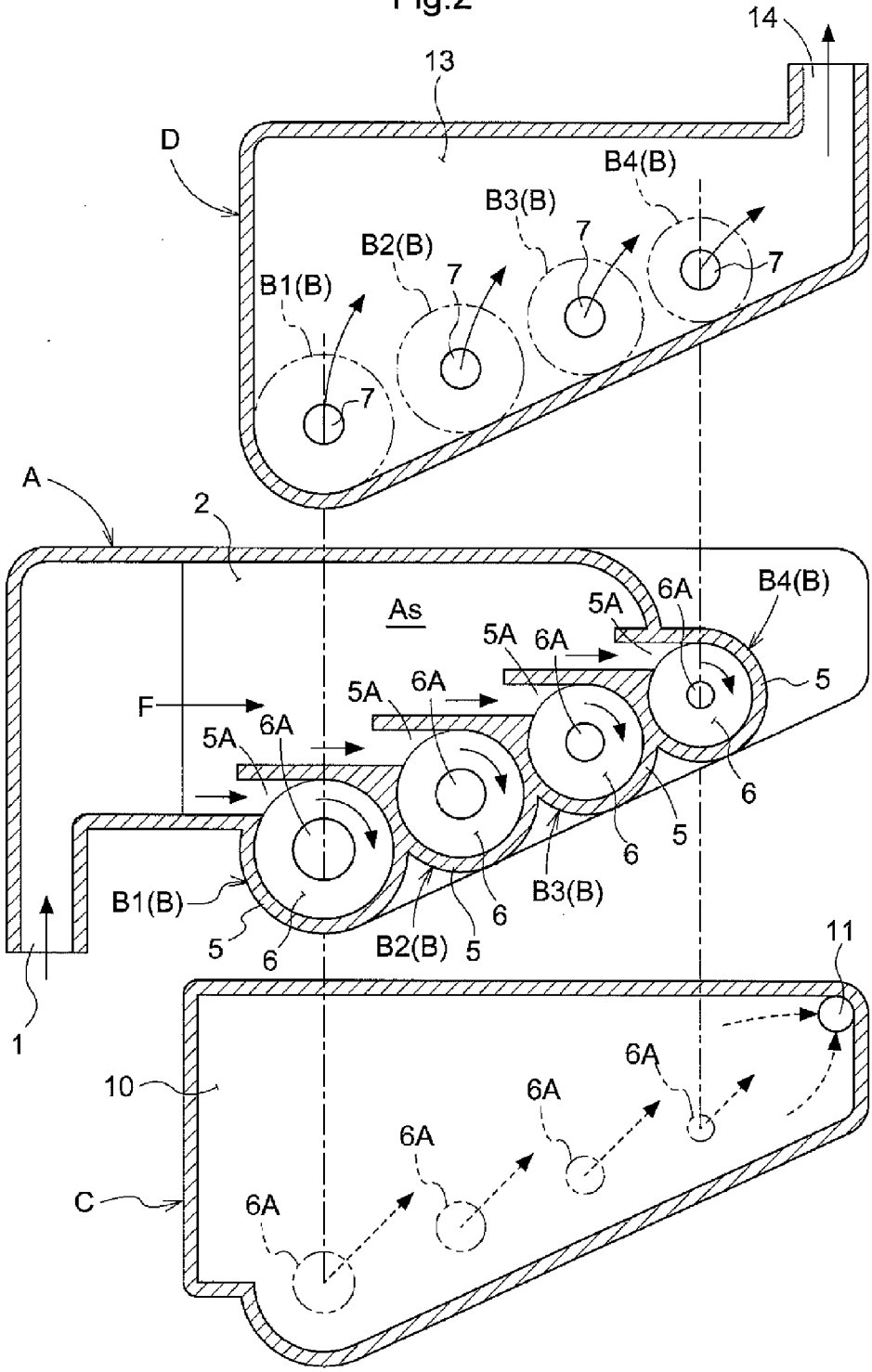
FIG. 2 is a deployment view of units of the oil separator.

As shown in FIGS. 1 and 2, an oil separator is configured by a gas supply portion A, four cyclone-type oil separation units B that separate out oil mist contained in blow-by gas from the gas supply portion A, an oil recovery portion C that recovers the oil collected by the oil separation units B, and a gas discharge portion D that discharges the blow-by gas from which oil mist was separated by the oil separation units B.

In this oil separator, blow-by gas produced in the crankcase of an engine E, which is an internal combustion engine, passes through a passage for return to the intake system of the engine E, and the oil separator has a function in which by causing the blow-by gas to flow from the gas supply portion A to the gas discharge portion D via the four oil separation units B, oil mist contained in the blow-by gas is separated out and collected by the four oil separation units B, and then the oil mist is caused to form droplets, which are recovered by the oil recovery portion C and discharged to an oil pan or the like of the engine E.

Oil Recovery Configuration

The gas supply portion A is shaped as a case overall and has a gas supply opening 1 at one end. Also, a supply space As, through which blow-by gas from the gas supply opening 1 is supplied horizontally along a gas supply direction F, is formed as a supply passage above a horizontally oriented intermediate wall 2.

The four oil separation units B each have a configuration including a cylindrical cylinder case part 5 centered about a vertically oriented axis, and a cone portion 6 that is formed integrally with the cylinder case part 5, is at a position below the cylinder case part 5, is centered about the axis, and decreases in diameter as it extends downward. A gas intake opening 5A is formed in a side surface of the cylinder case part 5, a discharge tube 7 that is coaxial with the axis of the cylinder case part 5 is provided in the upper portion thereof, and an oil discharge hole 6A for discharging oil is formed at the lower end of the cone portion 6.

Each of the oil separation units B functions such that by creating a flow for discharging blow-by gas from the discharge tube 7 to the gas discharge portion D using negative pressure, blow-by gas sucked in through the gas intake opening 5A circulates inside the cylinder case part 5 and is supplied to the cone portion 6, and oil mist is caused to coagulate and become collected in the cone portion 6. Also, in order to cause the sucked-in blow-by gas to circulate inside the cylinder case part 5, the gas intake opening 5A formed in each the cylinder case parts 5 is open in an orientation according to which blow-by gas flows toward the upstream side of the gas supply direction F in a direction tangential to the inner circumference of the cylinder case part 5. Also, the four gas intake openings 5A are arranged so as to extend farther toward the supply space As the more downstream they are, such that intake is not hindered by cylinder case parts 5 that are upstream in the gas supply direction F.

Adjacent cylinder case parts 5 of the oil separation units B are connected to each other, and the cylinder case parts 5 are formed integrally with the intermediate wall 2 of the gas supply portion A. Note that the oil separation units B may be configured so as to be separated from the gas supply portion A, and the oil separation units B may be formed integrally with the oil recovery portion C.

The oil recovery portion C is shaped as a case overall, and an oil discharge opening 11 for discharging oil is formed in the end portion on the low level side of a bottom wall 10 in an inclined orientation. The gas discharge portion D is shaped as a case overall, has a partition wall 13 formed on the lower side, and has a gas discharge opening 14 formed in one end portion. Note that the gas discharge opening 14 is located in the end portion on the downstream side of the gas supply portion A in the gas supply direction F.

This oil separator is assembled such that the gas supply portion A is placed over the oil recovery portion C, and then the gas discharge portion D is placed thereabove. Accordingly, the gas intake openings 5A of the cylinder case parts 5 are in communication with the supply space As, the oil discharge holes 6A of the cone portions 6 are in communication with the oil recovery portion C, and the upper ends of the discharge tubes 7 are in communication with the gas discharge portion D. Note that the discharge tubes 7 of the oil separation units B are formed integrally with the partition wall 13 of the gas discharge portion D.

Oil Separation Unit

In the oil separator of the present invention, the radii of the four oil separation units B centered about the axis are set to different values. Specifically, the one of the four oil separation units B that has the largest diameter is arranged in the supply space As at the most upstream position in the gas supply direction F in which the blow-by gas is supplied, and the one with the next smaller diameter is arranged downstream thereof in the gas supply direction F, such that the inner diameters of the cylinder case parts 5 of the oil separation units B are set so as to be larger the more upstream the position is in the gas supply direction F.

The four oil separation units B arranged in this way are given the reference signs B1, B2, B3, and B4 in downstream order from the one at the most upstream position in the gas supply direction F.

Oil Mist Collection Mode

The mist particles contained in the blow-by gas that have a smaller particle diameter float in the gas more easily and move a longer distance along with the gas compared to the particles that have a larger particle diameter. In contrast, the mist particles that have a larger particle diameter cannot move as long a distance as the particles that have a smaller particle diameter. The cyclone-type oil separation units are each configured such that blow-by gas supplied to the interior space of the cylindrical cylinder case part 5 circulates from the cylinder case part 5 into the cone portion 6 such that the mist is caused to coagulate so as to become separated out and collected and then discharged into the oil recovery portion C through the oil discharge hole 6A. Accordingly, a predetermined flow speed required for causing the gas to circulate is needed.

Also, due to the blow-by gas flowing from the gas supply opening 1 to the gas discharge opening 14, the blow-by gas in the supply space As flows in the gas supply direction F in the supply space As. The flow speed of the blow-by gas is higher the farther on the upstream side in the gas supply direction F, and lower the farther on the downstream side. Accordingly, the larger the particle diameter of a mist particle is, the less likely it is to reach the downstream side of the supply space As, and thus be sucked in by an oil separation unit B on the upstream side. Also, the smaller the particle diameter of a mist particle is, the more easily it flows to the downstream side, and thus be sucked in by an oil separation unit B on the downstream side.

For such reasons, the four oil separation units B (B1, B2, B3, and B4) having different inner diameters are arranged along the gas supply direction F in order from larger inner diameter to smaller inner diameter. The oil separation units B are arranged so as to protrude farther toward the supply space As (a direction different from the gas supply direction F) the more downstream the position is, such that gas intake is not hindered by an adjacent cylinder case part 5 during blow-by gas intake.

Accordingly, gas is efficiently taken in through the gas intake openings 5A without being hindered by an adjacent cylinder case part 5, gas is circulated with a set speed inside the cylinder case parts 5 of the oil separation units B having a large inner diameter, and mist particles with a favorably large particle diameter are collected. Also, in the oil separation units B having a smaller inner diameter, the speed of the gas is lower when being supplied from the gas intake opening 5A to the interior of the cylinder case part 5, but the flow speed of the gas rises after being sucked into the cylinder case part 5 due to the smaller inner diameter, and mist particles with a smaller particle diameter are collected.

In other words, giving consideration to the correspondence between the blow-by gas flow speed distribution in the supply space As and the mist particle diameter, the oil separation units B are arranged so as to be parallel along the gas supply direction F in the supply space As from the oil separation unit B with the largest inner diameter to the oil separation units B with the smallest inner diameter. Accordingly, the oil separation units B on the upstream side in the gas supply direction F exclusively collect large-diameter mist particles, and the oil separation units B on the downstream side exclusively collect small-diameter mist particles. This realizes efficient collection without imbalance in the collection amount in the oil separation units B.

Other Embodiments

Besides the above-described embodiment, the present invention may be configured as described below.

(a) The number of oil separation units B may be two or three, or may be five or more.

(b) As long as the oil separation units B are arranged with a tendency from larger diameter to smaller diameter along the gas supply direction F in the supply space As through which blow-by gas is supplied, gaps may be formed between the oil separation units B, and the oil separation units B can be placed in any arrangement, such as a staggered arrangement.

(c) The oil separator may have a configuration in which oil separation units B are arranged in two lines at positions sandwiching the supply space As. According to this configuration in which the oil separation units B are provided in two lines, oil collection can be performed more efficiently.

INDUSTRIAL APPLICABILITY

The present invention is applicable to an oil separator that collects oil mist in blow-by gas.

The invention claimed is:

1. An oil separator comprising a supply passage to which blow-by gas from an internal combustion engine is supplied, and a plurality of cyclone-type oil separation units arranged along a gas supply direction, each oil separation unit having a cylinder case part to which the blow-by gas is supplied, wherein an inner diameter of the cylinder case part of the oil separation unit is set larger with the oil separation unit arranged more upstream in the gas supply direction, the supply passage is configured by a supply space through which blow-by gas can be distributed, an intake opening of the oil separation unit having a larger inner diameter and an intake opening of the oil separation unit having a smaller inner diameter are arranged so as to be parallel along the gas supply direction in the supply space, axes of the cylinder case parts of the oil separation units are in a parallel orientation with respect to each other, and the axes are each set in an orientation orthogonal to the gas supply direction, and an intake opening formed in the cylinder case part of one of the oil separation units arranged downstream in the gas supply direction is arranged at a position so as to extend toward the supply space beyond an outer wall of the cylinder case part of the other of the oil separation units arranged upstream.

2. The oil separator according to claim 1, wherein the plurality of oil separation units are arranged so that the oil separation unit arranged more downstream in the gas supply direction protrudes more in a direction different from the gas supply direction.

3. The oil separator according to claim 1, wherein compared to an inner diameter of the cylinder case part of a first oil separation unit arranged most upstream in the gas supply direction, an inner diameter of a second oil separation unit arranged downstream of the first oil separation unit is set smaller, and an inner diameter of a third oil separation unit arranged downstream of the second oil separation unit is set smaller than the inner diameter of the second oil separation unit.

4. An oil separator comprising a supply passage to which blow-by gas from an internal combustion engine is supplied and which defines a supply space;

a first cyclone-type oil separation unit having a cylinder case part to which the blow-by gas is supplied; and a second cyclone-type oil separation unit having a cylinder case part to which the blow-by gas is supplied, the second oil separation unit being arranged downstream of the first cyclone-type oil separation unit in the gas supply direction, wherein an inner diameter of the cylinder case part of the first oil separation unit is set larger than an inner diameter of the cylinder case part of the second oil separation unit, intake openings of the first and second oil separation units are arranged so as to be parallel along the gas supply direction in the supply space, axes of the cylinder case parts of the first and second oil separation units are in a parallel orientation with respect to each other, and are each orthogonal to the gas supply direction, and the intake opening of the second oil separation unit extends further into the supply space in a direction orthogonal to the gas supply direction than the intake opening of the first oil separation unit.

* * * * *